United States Patent [19]

Greune

[11] Patent Number: 4,867,412

[45] Date of Patent: Sep. 19, 1989

[54] APPARATUS FOR THE PRODUCTION BY POWDER METALLURGY OF A SECTION OF A HEADER PIPE OF A HEAT EXCHANGER

[75] Inventor: Christian Greune, Fürstenfeldbruck, Fed. Rep. of Germany

[73] Assignee: Motoren-Und Turbinen-Union Munchen GmbH, Munich, Fed. Rep. of Germany

[21] Appl. No.: 215,610

[22] Filed: Jul. 6, 1988

[30] Foreign Application Priority Data

Jul. 7, 1987 [DE] Fed. Rep. of Germany ..... 3722329

[51] Int. Cl.[4] ..... B22D 19/04; B22C 9/26; B22F 3/12; B21D 53/08

[52] U.S. Cl. ..... 249/83; 249/95; 249/97; 249/145; 249/148; 249/151; 249/156; 249/176; 249/184; 29/157.3 R; 29/157.3 B; 29/157.3 H; 29/157.4; 425/78; 425/117; 425/577

[58] Field of Search ..... 29/157.3 R, 157.3 B, 29/157.3 H, 157.4; 249/145, 148, 95, 97, 94, 156, 176, 184, 83; 425/117, 78, 577

[56] References Cited

U.S. PATENT DOCUMENTS

| | | | |
|---|---|---|---|
| 2,391,615 | 12/1945 | Caron | 29/157.3 A |
| 3,873,805 | 3/1975 | Inoue | 29/157.3 R X |
| 3,970,488 | 7/1976 | Nelson | 249/95 X |
| 4,312,687 | 1/1982 | Sigworth, Jr. | 249/95 X |
| 4,491,557 | 1/1985 | Breitmoser et al. | 29/157.4 X |
| 4,715,576 | 12/1987 | Montierth | 249/176 X |
| 4,717,113 | 1/1988 | Martin | 249/184 X |

FOREIGN PATENT DOCUMENTS

| | | | |
|---|---|---|---|
| 3324915 | 4/1985 | Fed. Rep. of Germany . | |
| 584174 | 2/1947 | United Kingdom . | |
| 2141966 | 1/1985 | United Kingdom | 249/148 |

*Primary Examiner*—Timothy V. Eley
*Assistant Examiner*—Peter D. B. Vo
*Attorney, Agent, or Firm*—Roberts, Spiecens & Cohen

[57] ABSTRACT

Apparatus for the production by powder metallurgy of a heat exchanger block in which two spaced concentric half shells are provided with holes in which profiled pipes are inserted. The profiled pipes are internally supported by pins when metal powder is injected into the hollow space between the half shells for forming a wall section of a header. The radially outer half shell is formed by a plurality of half rings arranged with their side faces in contact with one another and the half rings are individually removed after the wall section is formed.

9 Claims, 3 Drawing Sheets

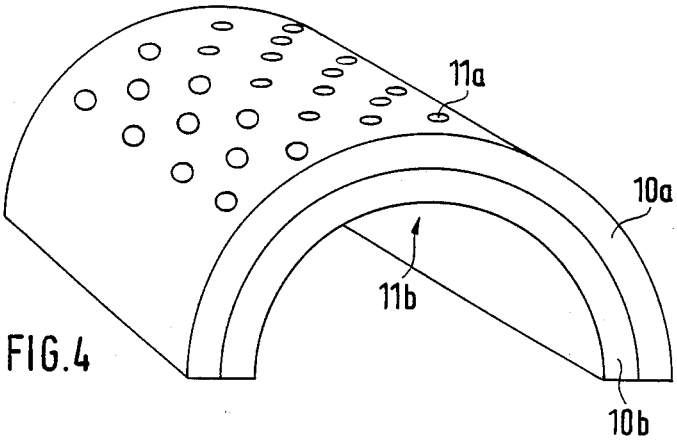
FIG.4
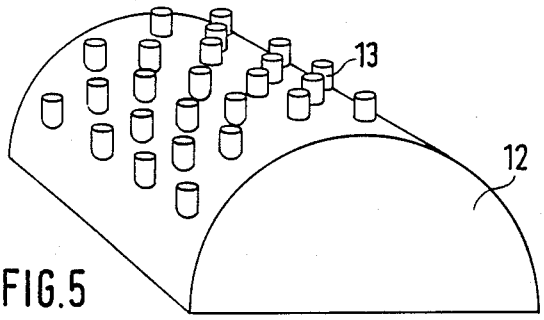
FIG.5
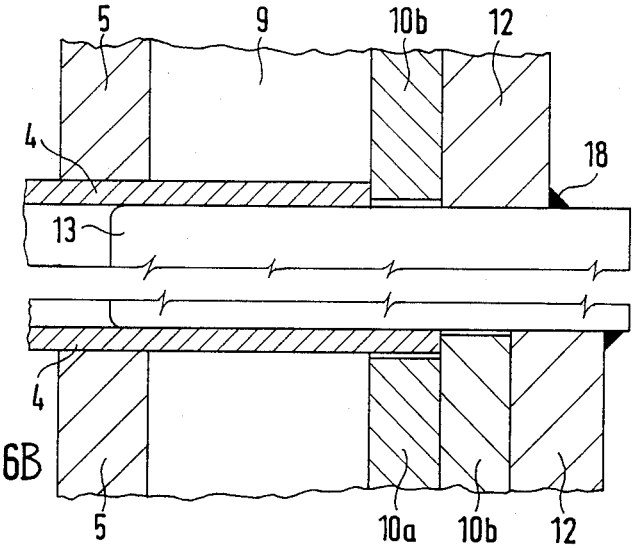
FIG. 6A
FIG.6B

APPARATUS FOR THE PRODUCTION BY POWDER METALLURGY OF A SECTION OF A HEADER PIPE OF A HEAT EXCHANGER

FIELD OF THE INVENTION

The present invention relates to a method and apparatus for the production by powder metallurgy of a section of a manifold or header pipe of a heat exchanger block and to permanent connection thereto of a plurality of profiled heat exchange pipes or tubes.

DESCRIPTION OF PRIOR ART

Federal Republic of Germany Patent No. DE 33 24 915 discloses a method of manufacturing such a heat exchanger block in which the profiled pipes are inserted into predetermined openings in a hollow mold and the mold is filled with sinter powder. After sintering, a wall section of the header pipe is formed in which the profiled pipes are firmly and hermetically connected.

This arrangement has the disadvantage that due to the hollow form only one limiting surface of the wall section to be formed is established. The wall thickness is predetermined by the amount of filling which has the disadvantage that the tolerances of the wall thickness can not be made small. This is made difficult, in particular, by the close arrangement alongside each other of the plurality of profiled pipes.

SUMMARY OF THE INVENTION

An object of the invention is to provide apparatus for producing a section of a header pipe of a heat exchanger block with permanently affixed profiled heat exchange tubes by which uncomplicated, rapid and economical manufacture is made possible and a precisely specified wall thickness of the header pipe can be obtained.

In accordance with the invention, the apparatus comprises a plurality of juxtaposed elements having abutting side surfaces which are provided with grooves cooperatively defining openings through which heat exchange pipes can extend. The elements are held in assembled juxtaposed relation as a half shell by releasable clamping devices. An inner shell is mounted within the half shell in spaced relation to define a space therewith corresponding to the desired section of the header pipe, the inner shell having apertures therein which are aligned with the openings in the half shell. A body having a surface facing the inner shell which corresponds in shape therewith is disposed within the inner shell and a plurality of pins are secured to the body and extend from its surface in alignment with the apertures in the inner shell and the openings in the half shell. The pins have an outer contour corresponding in shape to the interior of the heat exchange pipes so that the pipes can extend through the openings in the half shell and receive the pins therein and rest on the inner shell. Upon solidification of a sinterable powder injected into the space between the half shell and the inner shell, the section of the header pipe is formed with the heat exchange pipes embedded therein in gas-tight relation.

At the same time, the hollow space is fixed in its dimensions so that the wall thickness of the section of the header pipe to be produced can be established with close tolerance. Finally, a rapid and easy opening of the device and removal of the finished structural part is assured.

In a preferred embodiment, the pins extend into the openings in the half rings. In this way, the profiled pipes are internally supported in the entire region of their passage through the hollow space.

In another embodiment, two inner shells are provided, the apertures in the inner of the two shells having a shape and size such that the pins, but not the profiled pipes, pass therethrough. In this way, the ends of the profiled pipes can be supported in the outer of the two shells and the profiled pipes extend somewhat beyond the wall section so that additional solder connections can be produced between the profiled pipe and the wall section.

The hollow space is preferably filled with sinterable powder by an injection process, the powder being a plastic coated metal powder. In this way, a rapid filling and good compacting of the hollow space is obtained.

BRIEF DESCRIPTION OF THE FIGURES OF THE DRAWING

The invention will be further described below with reference to an embodiment shown in the drawings, in which:

FIG. 4 is a perspective view of two concentric inner shells of the device of FIG. 2;

FIG. 5 is a perspective view of a half cylinder of the device of FIG. 2;

FIG. 6A is a sectional view, on enlarged scale, of a modification of a portion of the device of FIG. 2; and FIG. 6B is similar to FIG. 6A and corresponds to FIG. 2.

DETAILED DESCRIPTION OF PREFERRED EMBODIMENTS

Figure 1:
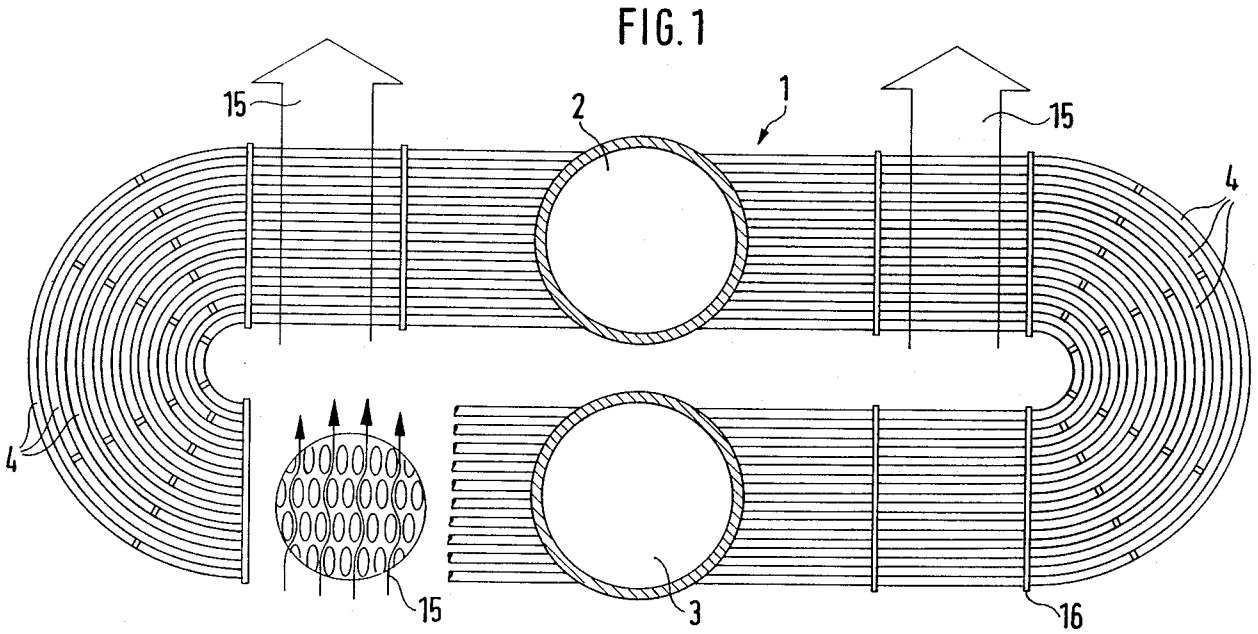
FIG. 1 is a side elevational view of a heat exchanger block.

FIG. 1 shows a heat exchanger block 1 which essentially comprises an inlet duct or header pipe 2 and an outlet duct or header pipe 3 which are parallel to one another, the header pipes being connected to each other by a plurality of profiled heat exchanger tubes or pipes 4 of U-shape. In operation, a fluid flows from the inlet header pipe 2 through the profiled pipes 4 to the outlet header pipe 3. At the same time, a stream of gas 15 is conducted perpendicularly to the profiled pipes 4 (cross flow/counterflow) so that heat exchange takes place between the two fluids through the walls of the profiled pipes 4. The profiled pipes 4 can be of round, elliptical or other streamlined cross section. The profiled pipes 4 are held in spaced relation by spacers 16 at a distance from header pipes 2 and 3.

Figure 2:
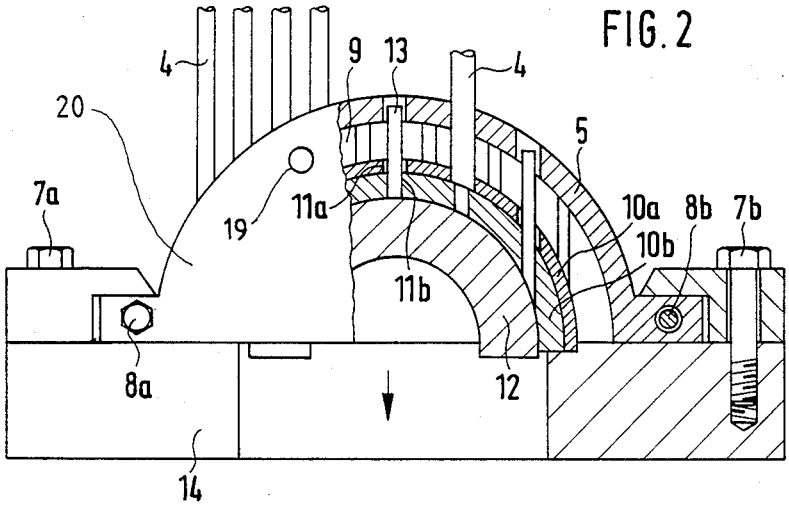
FIG. 2 is a side view, partially in section, of the device of the invention

FIG. 2 shows the apparatus of the invention in which a plurality of half rings 5 are arranged in juxtaposed abutting relation to one another on a base 14. The half rings 5 are clamped against each other by clamping devices **8*a* and 8*b* and the half rings are clamped to the base 14 by clamping devices 7*a* and 7*b*. Arranged radially within the half rings 5 are two concentric inner shells 10*a* and 10*b*, spaced from the half rings 5 to form a tubular hollow space 9. Radially spaced within the inner shell 10*b* is a semicylinder 12 which is not fixed on the base 14 but is removable through an opening in the base in the downward direction shown by the arrow in FIG. 2**.

Figure 3:
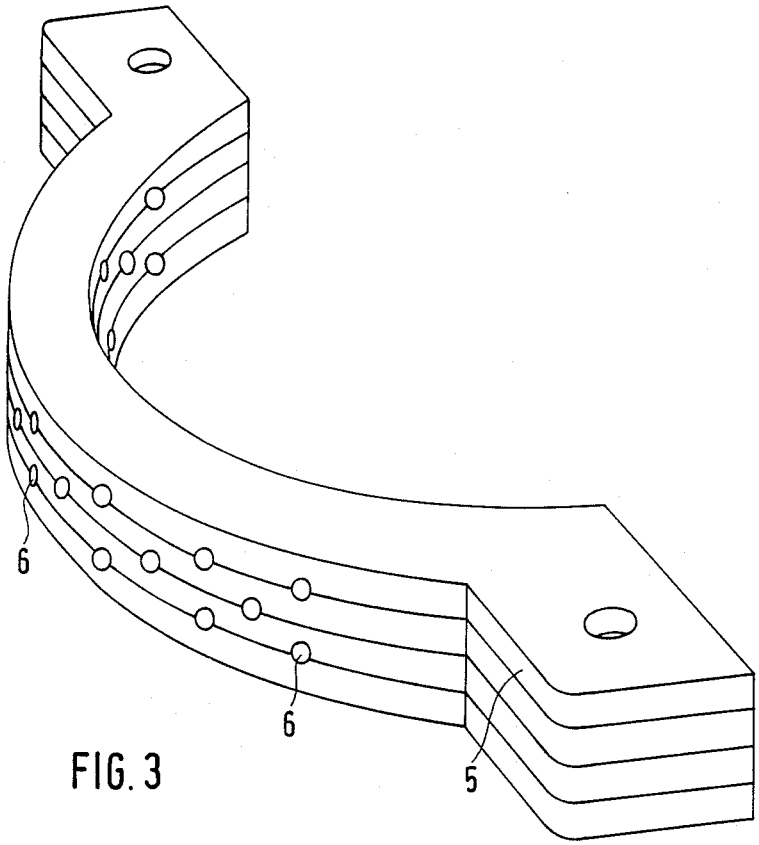
FIG. 3 is a perspective view of a number of half rings which form a part of the device of FIG. 2.

As seen in FIG. 3, the half rings 5 are provided with a plurality of grooves 6 at the joints between two adjacent half rings 5. The grooves 6 have a shape which corresponds precisely to the outer contour of the profiled pipes 4 so that the profiled pipes 4 can be inserted through the grooves.

Axially aligned with the grooves 6 in the half rings 5 are apertures 11*a* and 11*b* in the half shells 10*a* and 10*b*. The apertures 11*a* in the radially outer half shell 10*a* have the same shape and size as the grooves 6 so that the profiled pipes can be pushed through the apertures 11*a* as well. The apertures 11*b* have the shape of the inner contour of the profiled pipes 4 so that the inner shell 10*b* serves as a stop for the profiled pipes 4 which are pushed through grooves 6 and apertures 11*a*.

On the semicylinder 12 are mounted pins 13 which also have the shape of the inner contour of the profiled pipes 4. The pins 13 extend through the apertures 11*a* and 11*b* into the grooves in the half rings 5. A profiled pipe 4 shown in FIG. 2 passes through the groove 6 and aperture 11*a* and at its lower end it receives a pin 13 and rests on the inner shell 10*b*.

FIG. 4 shows the two concentric inner shells 10*a* and 10*b* in perspective, both being provided with a plurality of regularly distributed aligned apertures 11*a* and 11*b* which extend parallel to one another and perpendicular to the longitudinal axes of the shells.

FIG. 5 shows, in perspective, the semicylinder 12 with the pins 13 secured thereto, the pins having the shape of the inner contour of the profiled pipes 4.

FIGS. 6A and 6B show axial sections through a pin 13 according to different embodiments. In FIG. 6A there is shown an embodiment having only inner shell 10*b*, the profiled pipe 4 terminating at the inner surface of the wall section formed in the hollow space 9. The pins 13 are connected by weld attachments 18 to the semicylinder 12. In other embodiments, other means of connection can be made such as soldering, bolting, bonding or sintering.

In FIG. 6B the two inner shells 10*a* and 10*b* are employed and the profiled pipes 4 extend only through inner shell 10*a* and rest on the inner shell 10*b*.

Upon manufacture, a plastic-coated metal powder is injected under high pressure into the hollow space 9 through feed holes (not shown). After a certain amount of solidification has taken place, the semicylinder 12 is moved downward together with the pins 13 secured thereto. At the same time, the clamping devices 7*a*, 7*b* and 8*a*, 8*b* are released. Each individual half ring 5 can now first be pulled away upward and then removed entirely with elastic deformation of the profiled pipes 4. Upon the subsequent sintering process, a hermetic connection is produced between the profiled pipes 4 and the thus formed wall section.

The thus produced semicylindrical wall sections with the profiled pipes integrally assembled therewith are connected together to form header pipes 2 and 3. The connection of the wall sections can be effected by sintering, soldering or welding.

Each wall section preferably has about ¼ of the length of the header pipes 2 and 3, so that eight structural parts together form one heat exchanger block 1. The invention is not limited merely to the embodiments shown but by analogy can be utilized for any form of header pipe without going beyond the basic concept of the invention. Thus, for instance, in the case of an approximately rectangular cross section of the header pipe, the inner shells 10*a*, 10*b*, the half rings 5 and the half cylinder 12 can have a flat shape in their central section.

What is claimed is:

1. Apparatus for producing by powder metallurgy a section of a header pipe of a heat exchanger block to which a plurality of heat exchange tubes are permanently attached, said apparatus comprising:

a plurality of juxtaposed elements having abutting side surfaces which are provided with grooves cooperatively defining openings through which heat exchange tubes extend, releasable means holding said elements in assembled juxtaposed relation as a half shell, an inner shell mounted within said half shell in spaced relation to define a space between said inner shell and said half shell which corresponds to the desired section of the header pipe, said inner shell having apertures therein which are aligned with said openings in the half shell, a body within said inner shell having a surface facing said inner shell and corresponding in shape therewith, and a plurality of pins secured to said body and extending at said surface of the body in alignment with said apertures and said openings, said pins having an outer contour corresponding in shape to the interior of the heat exchange tubes such that said heat exchange tubes extend through said openings in the half shell and receive said pins therein and rest on said inner shell whereby upon injection of a sinterable powder into said space between the half shell and the inner shell, a compacted body is formed which, after sintering of the injected powder, said compacted body forms a section of the header pipe with said heat exchange tubes embedded therein.

2. Apparatus as claimed in claim 1 wherein said pins on said body extend into said openings in said half shell.

3. Apparatus as claimed in claim 2 further comprising a second inner shell mounted on the first said inner shell and having apertures of a size to receive said heat exchange tubes, said apertures in said first inner shell being smaller than the apertures in said second inner shell to prevent insertion therein of said heat exchange tubes while permitting passage therethrough of said pins.

4. Apparatus as claimed in claim 3 wherein said body is supported for displacement in a direction towards and away from said shells.

5. Apparatus as claimed in claim 1 wherein said elements of said half shell are shaped as half rings.

6. Apparatus as claimed in claim 5 wherein said inner shell has a semicylindrical surface facing said half shell.

7. Apparatus as claimed in claim 6 wherein said surface of said body which faces said inner shell is semicylindrical.

8. Apparatus as claimed in claim 7 wherein said semicylindrical surfaces of said inner shell and said body are concentric with said half rings of said half shell.

9. Apparatus as claimed in claim 8 wherein said body is supported for displacement radially with respect to said shells.

* * * * *